US006526885B2

(12) United States Patent
Walczak et al.

(10) Patent No.: US 6,526,885 B2
(45) Date of Patent: Mar. 4, 2003

(54) SUPPORT DEVICE FOR A PRINTING SLEEVE

(75) Inventors: Peter Walter Walczak, Lee, NH (US); Joseph Dushan Winnicki, Barington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/894,419

(22) Filed: Jun. 28, 2001

(65) Prior Publication Data

US 2003/0000402 A1 Jan. 2, 2003

(51) Int. Cl.[7] ..... B41F 27/00; B41F 30/00
(52) U.S. Cl. ..... 101/375; 29/895.23; 492/4
(58) Field of Search ..... 101/216, 217, 101/375, 376; 29/895.23, 895.21; 492/4, 5, 18, 47, 48

(56) References Cited

U.S. PATENT DOCUMENTS 3,611,536 A * 10/1971 Guenther et al. ..... 29/895.23
3,846,901 A * 11/1974 Lovett ..... 29/450
4,030,415 A * 6/1977 Fellows ..... 492/4
4,089,265 A 5/1978 White et al. ..... 101/375
4,573,251 A * 3/1986 Hillyard ..... 29/450
4,823,693 A 4/1989 Kobler ..... 101/375
4,856,425 A * 8/1989 Kobler ..... 101/216
5,072,504 A * 12/1991 Thompson ..... 29/895.23
5,429,048 A 7/1995 Gaffney et al. ..... 101/217
5,497,549 A * 3/1996 Rademacher ..... 29/895.21
5,537,923 A * 7/1996 Boor et al. ..... 101/375

* cited by examiner

*Primary Examiner*—Stephen R. Funk
(74) *Attorney, Agent, or Firm*—Davidson, Davidson & Kappel, LLC

(57) ABSTRACT

A printing sleeve in combination with a support device includes a printing sleeve having, a first end, a second end and an interior surface, and an inflation device acting on the interior surface of the printing sleeve when the printing sleeve is removed from a printing press. The combination advantageously permits the inflation device to act at both ends of the printing sleeve and also to make the combination portable.

19 Claims, 3 Drawing Sheets

SUPPORT DEVICE FOR A PRINTING SLEEVE

BACKGROUND OF THE INVENTION

The present invention relates generally to printing presses and more specifically to a device for aiding placement of a printing sleeve over a cylinder of a printing press.

U.S. Pat. No. 4,089,265 purports to disclose a cylinder end fitting sleeve next to a base tube. A flexographic sleeve may be placed over the end fitting sleeve. Radial bores connect with a pressure reducing manifold to aid in sliding a flexographic sleeve onto the base tube. The end fitting sleeve can be removed once the sleeve is on the base tube.

The end fitting sleeve only contacts the flexographic sleeve at only over a limited axial extent of the flexographic sleeve and the flexographic sleeve must be fit over the end fitting sleeve while the end fitting sleeve is attached to the base tube.

U.S. Pat. No. 5,429,048, incorporated by reference herein, discloses an offset lithographic printing press including a tubular-shaped printing blanket which may be axially-removed from a blanket cylinder. The blanket has a metal inner surface, a compressible material layer and a print layer.

Such a blanket may be expandable, for example using air pressure, to aid in placement and removal of the blanket. The metal inner layer thus may be rather thin to permit this expansion, and the blanket may not be extremely rigid.

Such blankets used on such offset lithographic printing presses typically have had a circumference equal to the height of the image to be printed, i.e. a blanket size of one image. When the blanket size increases to more than one image, for example two or three images, the blanket may lack strength and compress or collapse. The roundness of the tube thus may be compromised, making placement of the tube on the blanket cylinder difficult.

U.S. Pat. No. 4,823,693 purports to disclose an auxiliary apparatus used to apply a sleeve on a cylinder. The auxiliary apparatus has a cylindrical support on which the sleeve to be applied to the cylinder is retained. The auxiliary apparatus must be rolled next to the printing press and aligned with the cylinder. The sleeve is then removed from the cylindrical support and slid over the cylinder 3.

The auxiliary apparatus of the '693 patent is bulky and difficult to maneuver. Different height apparatuses must be supplied if the cylinders of the press with sleeves are at different heights, as the auxiliary apparatus rests on the ground. In addition a significant gap remains between the cylindrical support and the cylinder, and the placement of the large-sized sleeves with little stability on the cylindrical support is as difficult as placing the sleeve on the cylinder. Moreover, the sleeve extends axially far beyond the end of the cylindrical support. It is also difficult for a press operator to move the sleeve onto the cylinder, as the operator must stand to the side of the auxiliary device.

SUMMARY OF THE INVENTION

Commonly-owned U.S. Pat. Nos. 6,250,223 and 6,386,103 disclose blanket tube removal devices, which do not significantly increase the stability of a printing roll during placement.

An object of the present invention is to improve the stability of a printing roll when being placed on a cylindrically-shaped object.

The present invention provides a printing sleeve in combination with a support device comprising:

a printing sleeve having a first end, a second end and an interior surface; and a support device for acting on the interior surface, the support device having a first position where the support device acts on the interior surface at both the first end and the second end, the support device aiding placement of the sleeve on a cylinder of a printing press.

The support device thus can provide stability at both ends of the printing sleeve. As the printing sleeve is being slid onto its cylinder over a cylinder end, the support device can continue to provide support directly at the cylinder end.

Preferably, the support device is attached fixedly to the device at the first end.

The support device preferably is light weight so as to be liftable by a press operator. The combination of the sleeve and the support device preferably is, for example, less than 15 kilograms.

The support device preferably includes a support cup for clearing bearings at an end of the cylinder of a press onto which the sleeve is to be placed. Thus the support device can act directly on the second end, and a space between the cylinder and the support device can be avoided.

Preferably, the support device includes an inflation device to contact the inner surface when inflated. The inflation device is easily placed inside the sleeve, even if the sleeve is unstable or flimsy. The inflation device may then be inflated to provide the desired stability.

The present invention thus also provides a printing sleeve in combination with a support device comprising:

a printing sleeve having a first end, a second end and an interior surface; and an inflation device for acting on the interior surface of the printing sleeve when the printing sleeve is removed from a printing press.

Preferably, the inflation device includes a bellows-type support tube, and the bellows can collapse as the sleeve is pushed over its respective cylinder. The bellows may be supported by a spring support.

The inflation device may include an end part fastenable to the sleeve, and an air valve, so that as the bellows collapses, air is released and the end part remains fastened. The end part may be for example a disk made of plastic or metal. An air pressure gauge also may be provided to measure the pressure in the inflation device. An air hose can supply air through the air valve.

The end part may be fastened to the sleeve using an end ring. Opposite the end part may be the support cup for fitting over the cylinder end bearings.

The printing sleeve preferably is an offset lithographic blanket sleeve, but may be any type of printing sleeve.

The present invention also provides a method for placing a printing sleeve on a printing press comprising the steps of:

placing an inflation device inside a printing sleeve when the sleeve is removed from a printing press cylinder, and placing the printing sleeve over the cylinder.

Preferably, the inflation device deflates during the placing step.

The present invention further provides a method for placing a printing sleeve on a printing press comprising the steps of:

placing a support device inside a printing sleeve so that the support device contacts both a first end and an opposing second end of the printing sleeve when the sleeve is removed from a printing press cylinder, and placing the printing sleeve over the cylinder.

Preferably, the placing step includes a press operator holding both the printing sleeve and the support device.

The present invention also provides a printing sleeve in combination with a support device comprising:

a printing sleeve having a first end, a second end and an interior surface; and a support device for acting on the interior surface, the support device and the printing sleeve being portable.

Portable as defined herein means that a press operator can lift the combination from the ground and place the combination on a cylinder.

The sleeve preferably is a printing blanket with two sets of images around the circumference.

BRIEF DESCRIPTION OF THE DRAWINGS

The present invention is described below by reference to the following drawings of a preferred embodiment, in which.

DETAILED DESCRIPTION

Figure 1:
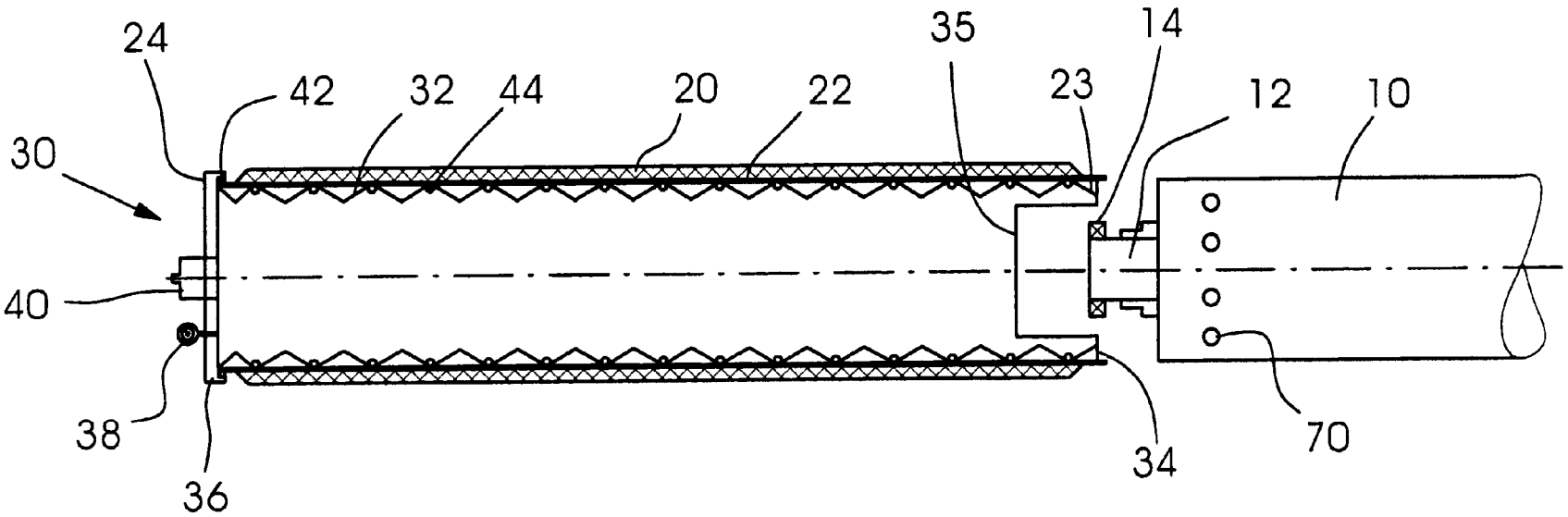
FIG. 1 shows a side view of the support device and printing sleeve of the present invention.

FIG. 1 shows a support device 30 for acting on an interior surface 22 of a printing sleeve 20, for example an offset lithographic printing blanket, having a first end 23 and a second end 24. Sleeve 20 fits over a printing cylinder 10 of a printing press. Cylinder 10 is held in a cantilevered-fashion on one side, so that an end 12 shown can remain free when a door in the press frame is opened. At end 12 are bearings 14 for interacting with the door when closed. Air holes 70 of cylinder 10 can be used to provide pressure against the interior surface 22 of the sleeve when being fit over cylinder 10.

The support device 30 includes a support cup 34, which is generally circular in shape and has a diameter less than or equal to the diameter of interior surface 22. Preferably, the diameter of cup 34 is less than the diameter of interior surface 22. The cup 34 has a central cup-shaped section 35, which can fit over bearings 14.

Attached to the cup 34 at its outer edges is a bellows-type inflatable rubber tube 32, shown here solely for clarity in a not-fully inflated position. In the fully inflated position the entire tube 32 would press against inner surface 22. At the end 24, the tube 32 is connected in a sealed manner to an end disc 36, for example made of plastic or metal. An O-ring grip and O-ring 42 can be used for this seal, and also to firmly attach the end disc 36 to sleeve 20 at end 24. The O-ring 42 may be made for example of rubber or metal.

The cup 34, inflatable tube 32 and end disc 36 thus define-an inflation device which can inflate so that tube 32 presses against the entire interior surface 22 of sleeve 20.

Inside the tube may be located a spring 44, for example a coil made of metal, pushing the disc 36 and cup 34 away from each other and providing some support to the tube 32. Alternately, the spring 44 may only cover a limited axial extent of the tube.

At the disc 36 is placed an air valve 40. The air valve 40 permits air to enter tube 32, and may release air once a certain pressure is reached inside the inflation device. A pressure gauge 38 may measure the air pressure of the device.

Fully-inflated tube 32 can act to supply pressure to the entirety of interior surface 22, thus making the sleeve 20 rigid and simplifying handling of the sleeve 20. Placement of the sleeve end 23, which has cup 35, onto the cylinder 10 is possible. Moreover, the sleeve 20 and inflation device combination is portable, which is defined herein to mean that an operator may lift the combination and place the combination on the cylinder 10. Portability is highly advantageous, as no external devices with wheels such as dollies are required. The cylinder 10 may support both the sleeve 20 and the inflation device when the sleeve 20 is being slid onto the sleeve 20, so that the operator may push the sleeve axially without needing to support the weight of the sleeve or inflation device.

Figure 2:
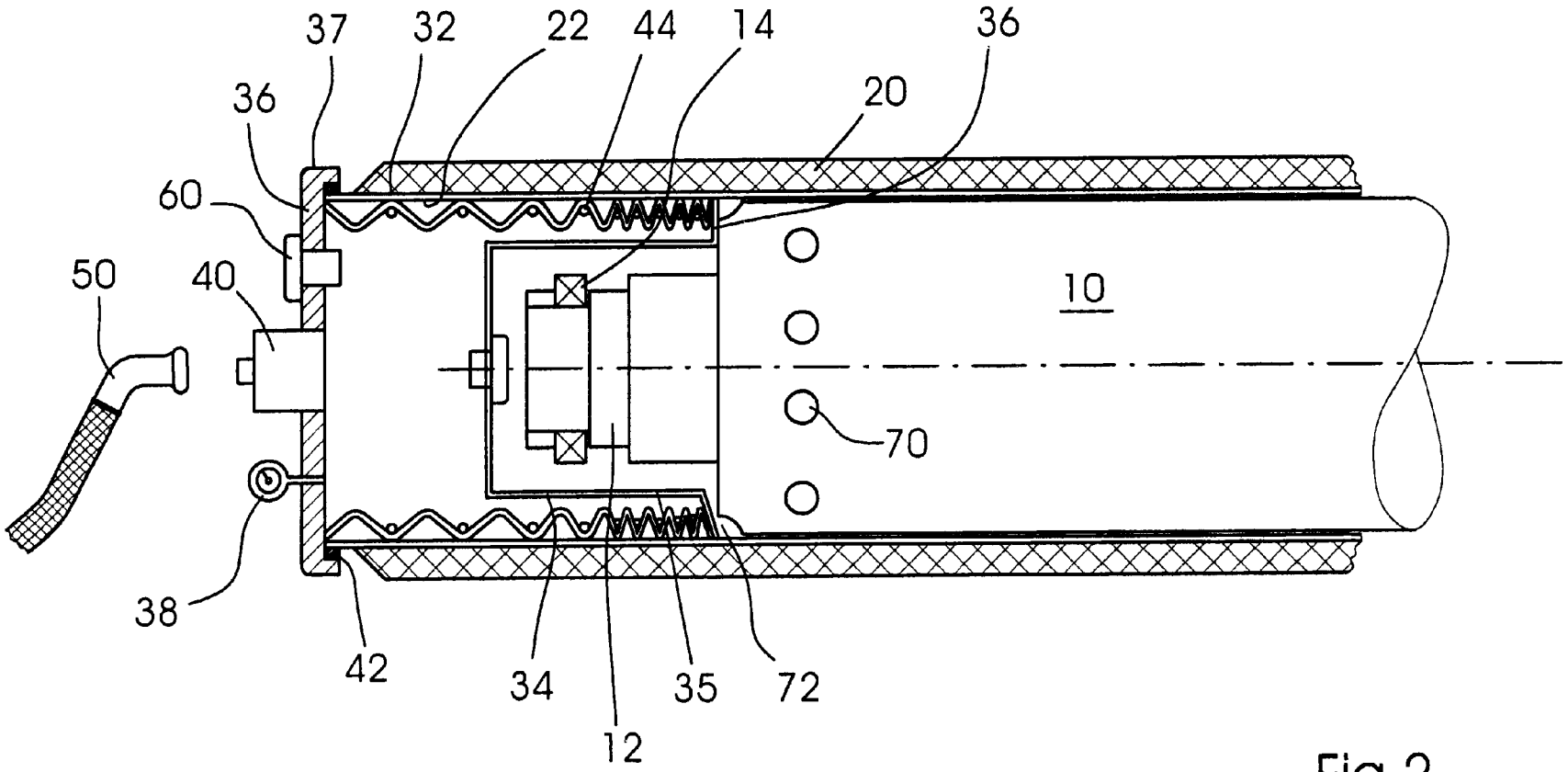
FIG. 2 shows more details of the support device as the printing sleeve is being placed over a cylinder of a printing press.

FIG. 2 shows more details of the inflation device as the sleeve 20 is being slid onto the cylinder 10, and includes additional optional features with an intake air valve 61 and a pressure release valve 60. Cup-shaped section 35 of cup 34 fits over the bearings 14 on end 12, so that a contact surface 136 of cup 34 contacts cylinder 10. As the sleeve 20 is pushed onto cylinder 10, the operator may release valve 40, so that tube 32 deflates. As the sleeve 20 is further placed on the cylinder 10, tube 32 can fold in a bellows-type manner as shown, and air can escape out valve 40 or 60. Once sleeve 20 is almost fully on the cylinder 10, the end disk 36 can be removed by pulling O-ring grip 37 of the disk 36 over O-ring 42, which is connected to the outer surface of sleeve 20. The inflation device with cup 34 is then released from the sleeve 20 and may be removed. The sleeve 20 then can be fully placed over cylinder 10, the door closed over bearings 14 and the press operated.

If desired, the inflation device may be placed on again as the sleeve is removed, with an air supply 50 of compressed air supplied buy an operator causing tube 32 to expand. This also can aid in removal of the sleeve 20, as contact surface 136 then presses against cylinder 10 and forces end 24 away from cylinder 10 through the O-ring grip 37.

Figure 3:
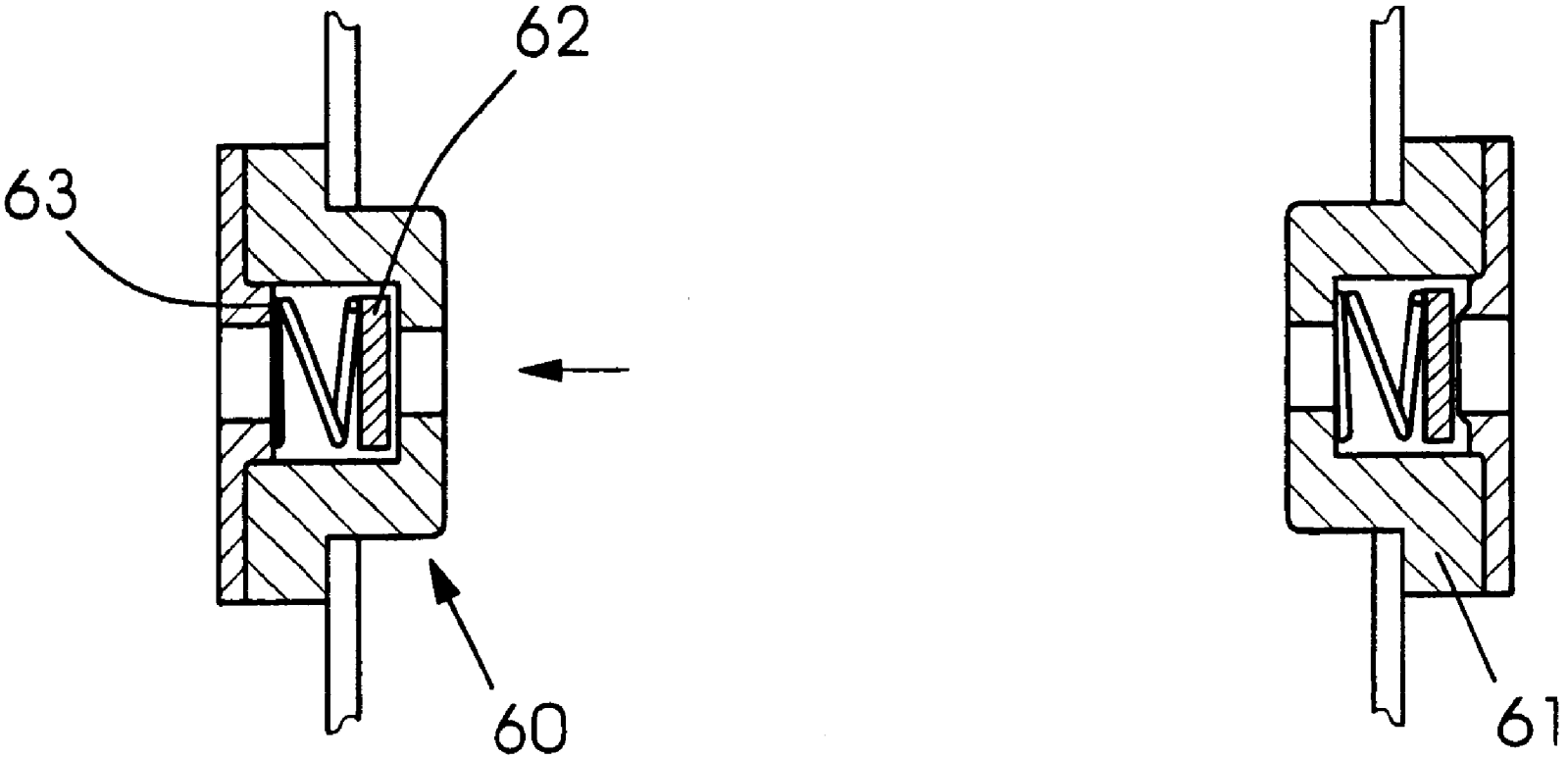
FIG. 3 shows more details of intake valve 61 and release valve 60.

Alternately or in addition, air from holes 70 could be used to inflate the tube 32, for example through an air by-pass channel 72. The air then passes through a pressure valve 61 into tube 32. A pressure release valve 60 can be set so that the air in the tube 32 causes the tube to expand slowly. Valves 61 and 60 are shown in FIG. 3. A pressure disk 62 sits on a spring 63, the spring strength for each valve being selected to permit the air from holes 70 to inflate the tube 32 gently.

The inflation device may also remain on the sleeve during operation in an extension area of the sleeve.

What is claimed is:

1. A printing sleeve in combination with a support device comprising:

a printing sleeve having a first end, a second end and an interior surface; and an inflatable device acting on the interior surface of the printing sleeve when the printing sleeve is removed from a printing press.

2. The printing sleeve in combination with a support device as recited in claim 1 wherein the inflatable device includes a bellows-type support tube.

3. The printing sleeve in combination with a support device as recited in claim 2 wherein inflatable device includes a spring support within the support tube.

4. The printing sleeve in combination with a support device as recited in claim 1 wherein the inflatable device includes an end part fastenable to the sleeve.

5. The printing sleeve in combination with a support device as recited in claim 1 wherein the inflatable device includes an air valve.

6. The printing sleeve in combination with a support device as recited in claim 1 wherein the inflatable device includes an end cup for fitting over cylinder end bearings.

7. The printing sleeve in combination with a support device as recited in claim 1 wherein the printing sleeve is an offset lithographic blanket sleeve.

8. The printing sleeve in combination with a support device as recited in claim 7, wherein the blanket sleeve has two or more images about a circumference.

9. A printing sleeve in combination with a support device comprising:

a printing sleeve having a first end, a second end and an interior surface; and an inflatable support device for acting on the interior surface, the support device and the printing sleeve being portable.

10. The printing sleeve in combination with a support device as recited in claim 9 wherein the support device is fixable to the printing sleeve.

11. A printing sleeve in combination with a support device comprising:

a printing sleeve having a first end, a second end and an interior surface; and a support device for acting on the interior surface, the support device having a first position where the support device acts on the interior surface at both the first end and the second end, the support device aiding placement of the sleeve on a cylinder of a printing press, the support device including an inflation device to contact the inner surface when inflated.

12. The printing sleeve in combination with a support device as recited in claim 11 wherein the support device is attached fixedly to the printing sleeve at the first end.

13. The printing sleeve in combination with a support device as recited in claim 11 wherein the combination is portable.

14. A printing sleeve in combination with a support device comprising:

a printing sleeve having a first end, a second end and an interior surface; and a support device for acting on the interior surface, the support device having a first position where the support device acts on the interior surface at both the first end and the second end, the support device aiding placement of the sleeve on a cylinder of a printing press; wherein the support device includes a support cup for clearing bearings at an end of the cylinder of the printing press.

15. A method for placing a printing sleeve on a printing press comprising the steps of:

placing an inflatable device inside a printing sleeve when the sleeve is removed from a printing press cylinder, inflating the inflatable device; and placing the printing sleeve over the cylinder.

16. The method as recited in claim 15 wherein the inflatable device deflates during the placing step.

17. A method for placing a printing sleeve on a printing press comprising the steps of:

placing an inflatable support device inside a printing sleeve so that the support device contacts both a first end and an opposing second end of the printing sleeve when the sleeve is removed from a printing press cylinder, and placing the printing sleeve over the cylinder.

18. A method for placing a printing sleeve on a printing press comprising the steps of:

placing a support device inside a printing sleeve so that the support device contacts both a first end and an opposing second end of the printing sleeve when the sleeve is removed from a printing press cylinder, and placing the printing sleeve over the cylinder wherein the placing step includes having a press operator lift the printing sleeve and the support device.

19. A support device for a printing sleeve comprising:

an end disc for attaching to a printing sleeve; and an inflatable rubber tube sealingly attached to the end disc for acting on an inner surface of the printing sleeve.

* * * * *